United States Patent [19]

Burns

[11] Patent Number: 4,728,131

[45] Date of Patent: Mar. 1, 1988

[54] CAMPER SHELL INSIDE DOOR LOCK

[76] Inventor: Russel D. Burns, 11872 Beach Blvd., Stanton, Calif. 90680

[21] Appl. No.: 862,109

[22] Filed: May 12, 1986

Related U.S. Application Data

[63] Continuation-in-part of Ser. No. 683,482, Dec. 19, 1984, abandoned.

[51] Int. Cl.[4] ..... E05C 5/00

[52] U.S. Cl. ..... 292/7; 292/153; 292/210

[58] Field of Search ..... 292/7, 209, 210, 256.69, 292/65, 66, 153, 181, 304; 70/212, 162

[56] References Cited

U.S. PATENT DOCUMENTS

| | | | |
|---|---|---|---|
| 139,082 | 5/1873 | Rittenhouse | 292/153 X |
| 1,113,040 | 10/1914 | Moore | 292/7 X |
| 1,496,551 | 6/1924 | McCulloch | 292/337 |
| 1,564,953 | 12/1925 | Gertsfeld | 292/153 |
| 1,938,258 | 12/1933 | Luneburg | 292/210 |
| 2,864,638 | 12/1958 | Nelson et al. | 292/256.69 |
| 3,831,989 | 8/1974 | Gurzenda | 292/DIG. 15 X |
| 4,046,410 | 9/1977 | Connell | 292/66 X |

FOREIGN PATENT DOCUMENTS

| | | | |
|---|---|---|---|
| 70321 | 6/1915 | Austria | 292/209 |
| 102770 | 4/1899 | Fed. Rep. of Germany | 292/209 |

*Primary Examiner*—Lloyd A. Gall

*Attorney, Agent, or Firm*—Edward E. Roberts

[57] ABSTRACT

A locking apparatus for a pickup camper shell which includes a metallic plate member having a generally right-angularly disposed integrally formed pivot portion for pivotally attaching thereto a latch arm, the latch arm having a latch portion defining an opening for captively receiving therein the locking bar of a camper shell locking mechanism, with a transversely bent portion of the latch arm being configured for grasping and pivoting of the latch arm. A coacting protrusion and depression are formed on abutting surfaces of the pivot portion and latch arm for retaining the parts in an open position to prevent inadvertent locking of the apparatus due to movement of the vehicle. The plate member is secured to a portion of the camper shell in proximity to the locking bars, with the opening of the latch arm aligned for capture and retention of the locking bar. The opening has an angularly disposed outer edge to force the latch arm down on attempted intrusion by rotation of the door handle from the exterior.

18 Claims, 7 Drawing Figures

FIG. 5.
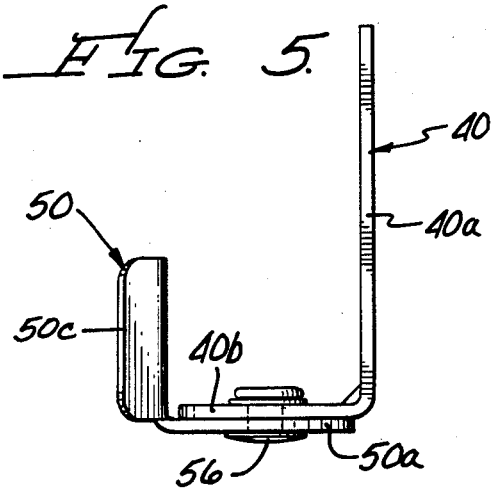
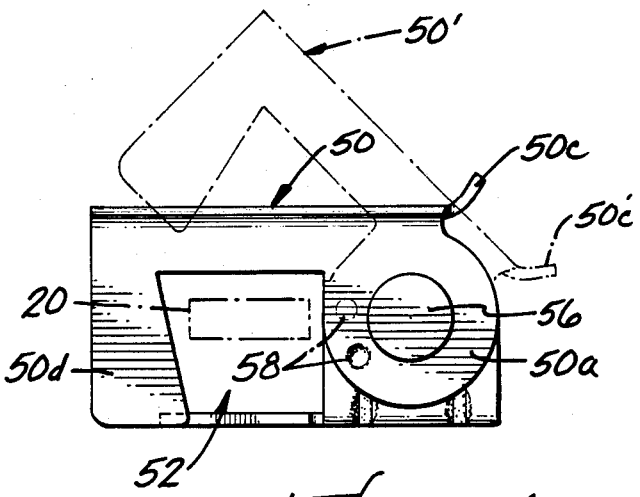
FIG. 4.
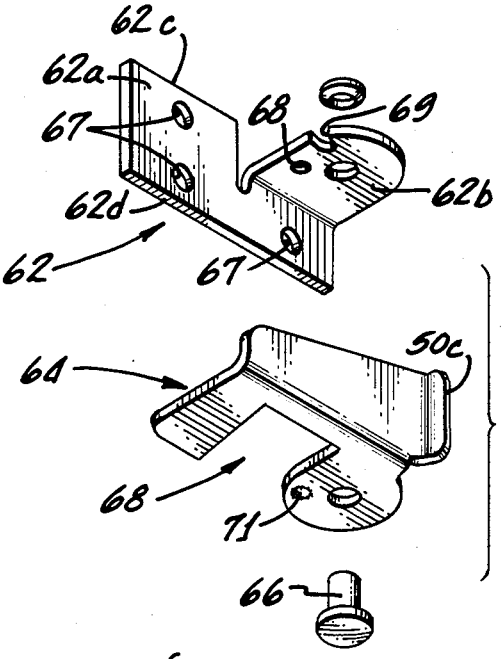
FIG. 7.
FIG. 6.
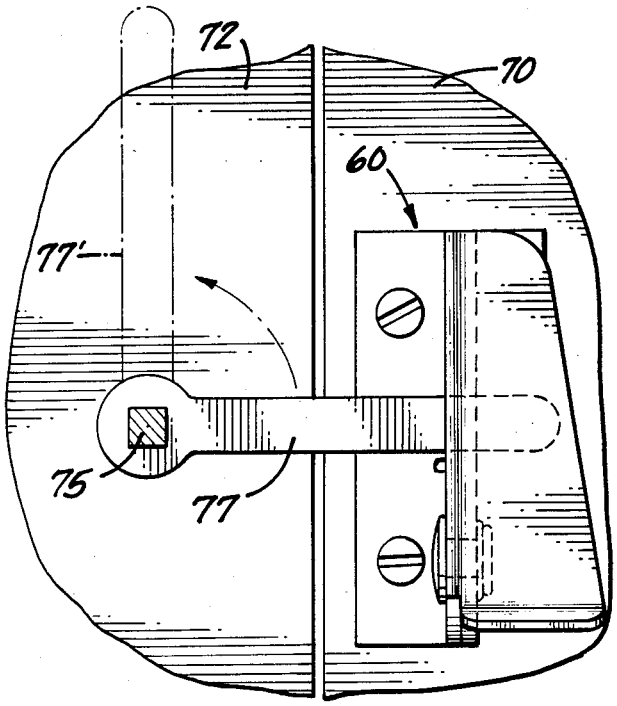

CAMPER SHELL INSIDE DOOR LOCK

CROSS-REFERENCE TO RELATED APPLICATION

This application is a continuation-in-part of U.S. patent application Ser. No. 683,482, now abandoned, entitled "Camper Shell Inside Door Lock", filed Dec. 19, 1984, by the inventor herein.

BACKGROUND OF THE INVENTION

The background of the invention will be discussed in two parts.

1. Field of the Invention

This invention relates generally to door locks for light camper shell doors, and particularly to door locks for campers that fit on pickup trucks and have a short bar or an elongate bar that engages a portion of the truck frame or another portion of the camper shell for securing the door.

2. Description of the Prior Art

In the camper field the need for an inside door lock has existed for some time. In large trailers and motor homes, the doors are provided with locks that lock from both outside and inside. However, in more recent years, there has been a wisespread increase in the use of camper shells for pickup trucks. Although the majority of such camper shells are intended for assembly to the pickup truck with the tail gate still attached to the truck, some camper shells provide larger door openings for entry by campers, with the larger door entries being accommodated by removal of the tail gate. Such camper shells are normally secured to the pickup truck, such as by bolts, usually accessible from the interior of the shell. One or more doors may be provided for access to the compartment within the shell formed by the pickup truck bed and the shell.

In the first instance, the doors generally pivot about the roof of the shell, that is, the door pivots about a horizontal hinge. In the larger camper shell units, the door or doors pivot about a vertically disposed hinge arrangement attached to the camper shell. On virtually all camper shells, the door is provided with a locking arrangement which permits locking only from the outside. Such locks are intended to deter the theft of the contents of the truck in the pickup bed when the vehicle is unattended. However, such camper shells have achieved popularity for camping purposes, in which event, it is desirable to provide some means for locking the door from the interior when the pickup bed is used for sleedping quarters.

The locking mechanisms on such camper shells differ in design, but follow one of three basic configurations. In one instance, the simplest method for a vertically or horizontally hinged door is to provide a short locking bar which is fixed relative to, and pivots with, the door handle, and engages a stationary part of the shell or tail gate in the closed position, thus latching the door. The locking mechanism can be locked only from the outside and simply prevents rotation of the handle from the exterior.

In a more complicated door latching arrangement, the handle on the door operates a lever arm on the interior, rotation of which axially displaces an elongate locking bar which passes through an eye fixed to and adjacent an end of the door, in proximity to a slot or catch opening on a stationary part of the shell or truck. Rotation of the door handle then moves the end of the locking bar into or out of the catch opening. In the more sophisticated latching arrangements, a pair of locking bars are manipulated simultaneously by the handle lever with a pair of aligned catch openings in a stationary part of the shell or truck being simultaneously engaged. The locking bars in such instances are exposed and accessible from the interior of the camper shell.

It is accordingly an object of the present invention to provide a new and improved locking apparatus for use on the interior of a camper shell.

It is another object of the present invention to provide a new and improved camper shell locking apparatus which engages the locking bars of presently existing latching arrangements for camper shells.

It is still another object of the present invention to provide a new and improved camper shell locking apparatus which engages the locking bars of presently existing latching arrangements for camper shells and which can be readily attached to existing camper shells.

SUMMARY OF THE INVENTION

The foregoing and other objects of the invention are accomplished by providing a locking apparatus which includes a metallic plate member having a generaly right-angularly disposed integrally formed pivot portion for pivotally attaching thereto a latch arm, the latch arm having a latch portion defining a recess or opening for captively receiving therein the locking bar, with a transversely bent portion of the latch arm being configured for grasping and pivoting of the latch arm. A coating protrusion and depression are formed on abutting surfaces of the pivot portion and latch arm for retaining the parts in an open position to prevent inadvertent locking of the apparatus due to movement of the vehicle. The plate member is secured to a portion of the camper shell in proximity to the locking bar, with the opening of the latch arm aligned for capture and retention of the locking bar. The opening has an angularly disposed outer edge to force the latch arm down on attempted intrusion by rotation of the door handle from the exterior.

Other objects, features and advantages of the invention will become apparent from a reading of the specification when taken in conjunction with the drawings, in which like reference numerals refer to like elements in the several views.

BRIEF DESCRIPTION OF THE DRAWINGS

FIG. 4 is a front view of the locking apparatus of FIG. 3;

FIG. 5 is an end view of the locking apparatus of FIG. 3;

FIG. 6 is a front view of an alternate embodiment of the locking apparatus according to the invention assembled to a camper shell door for engagement with a short locking bar thereof; and FIG. 7 is an exploded perspective view of the locking apparatus of FIG. 6.

DESCRIPTION OF THE PREFERRED EMBODIMENTS

Figure 1:
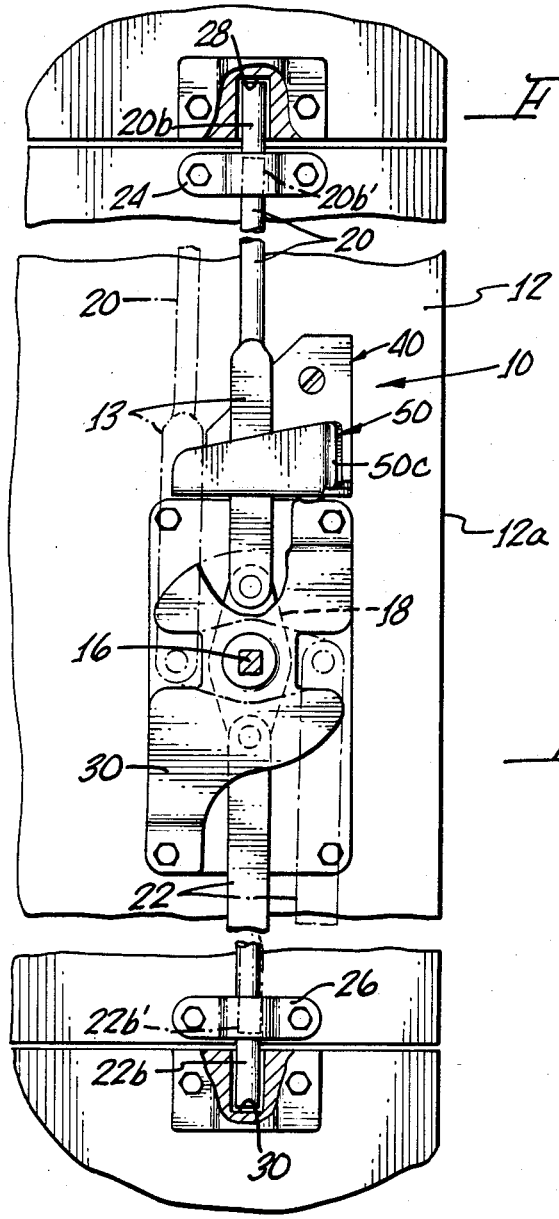
FIG. 1 is a perspective view of the locking apparatus according to the invention secured to a door of a camper shell for engaging an articulated elongate locking bar thereof.

Referring now to the drawings, and particularly to FIG. 1, there is shown a door locking apparatus, generally designated 10, attached to the interior of a camper shell door 12. The door locking mechanism 10 includes a door handle (not shown) on the exterior of the door 12, rotation of which rotates a shaft 16 of square cross-section. Keyed to the shaft 16 for rotation therewith is a symmetrically configured actuating lever 18 which is pivotable through an angle of approximately ninety degrees to the position shown in dotted lines.

One or more elongate locking bars 20, 22, each have first ends thereof pivotally attached to the ends of the lever 18, such as with rivets, for reciprocation of the bars 20, 22 in response to movement or pivoting of the shaft 18 of the door handle. Such bars 20, 22 may have a flattened portion at the said first ends for facilitating coaction with the lever 18 which is usually formed as a stamped piece of bar stock metal. The opposite ends **20*b*, 22*b*, of the locking bars 20, 22 may be flat, or preferably of round cross-section, and are suitably restrained for slidable vertical movement only, as viewed in FIG. 1, by means of restraining members 24, 26 suitably attached to the interior of the door 12** adjacent the upper and lower edges, respectively, thereof.

Each restraining member 24, 26 is configured with an elongate opening for passage therethrough of the end **20*b*, 22*b*, of the locking bars 20, 22, respectively. The ends 20*b*, 22*b* are slidable within the restraining members 24, 26, with the openings thereof having a width sufficient to permit a certain amount of lateral movement, and a depth slightly greater than the dimension of the end 20*b*, 22*b* of the bars 20, 22**.

Briefly, it is the function of the restraining members 24, 26 to permit a certain amount of sideways movement of the ends **20*b*, 22*b*, while permitting limited movement or play in a direction perpendicular to the plane of the drawing. Adjacent the ends 20*b*, 22*b*, are a pair of aligned catch openings 28, 30 configured for receiving therein the ends 20*b*, 22*b*, respectively, with the locking mechanism 10 in the closed or locked position. These openings 28, 30** are normally formed, for example in opposing jamb portions of the doorway formed in the camper shell.

In such camper shells, as previously discussed, the door 12 may be hinged vertically or horizontally, and it is to be understood that the illustration of FIG. 1 may be rotated ninety degrees clockwise to depict a door 12 hinged horizontally. Furthermore, with respect to the catch openings 28, 30, it is to be understood that either or both of the openings may be formed in a separately attached bracket member, or may be formed in the pickup truck bed or sidewalls. In any event, the catch openings 28, 30 are in fixed relation to the pickup truck bed.

In the locked or latched postion, as shown in solid lines in FIG. 1, the locking bars 20, 22 are in axial alignment, and generally parallel to the hinge thereof (not shown), or to the edge **12*a* of the door 12. As the handle is rotated ninety degrees, resulting in the lever 18 being in the dotted line position, the ends 20*b*, 22*b* of the locking bars retract, that is they move to the dotted line positions 20*b*′, 22*b*′, in which the extreme ends are near the restraining members 24, 26 and inside the vertical dimension of the door 12** to permit the door to be opened.

Referring now, also to FIGS. 2 through 5, the locking apparatus 10 includes a plate member 40 and a latch arm 50 pivotally attached thereto by suitable means such as a rivet 56. Each of these members is formed such as by stamping and bending from a single piece of sheet metal of sufficient thickness for the required rigidity. The plate member 40 has a plate-shaped base portion **40*a* and a right-angularly extending pivot portion 40*b* at one edge thereof. The base portion 40*a* is a broadly dimensioned mounting plate with a plurality of apertures 42*a*, 42*b* and 42*c* formed therein for passage therethrough of suitable fastener members, such as screws 43**.

The pivot portion **40*b* is of shorter dimension than the edge 40*c* of plate 40 for reasons which will become obvious. The pivot portion 40*b* at the upper end thereof, that is the end removed from the base portion 40*a*, is rounded, with an arcuate recess 44 formed therein. A pivot aperture 45 is located centrally relative to the radius of curvature of the rounded edge of the pivot portion 40*b*. An aperture or depression 46 is formed in the surface of the pivot portion 40*b* adjacent the aperture 45, the depression 46 being angularly displaced from the recess 44**.

Figure 2:
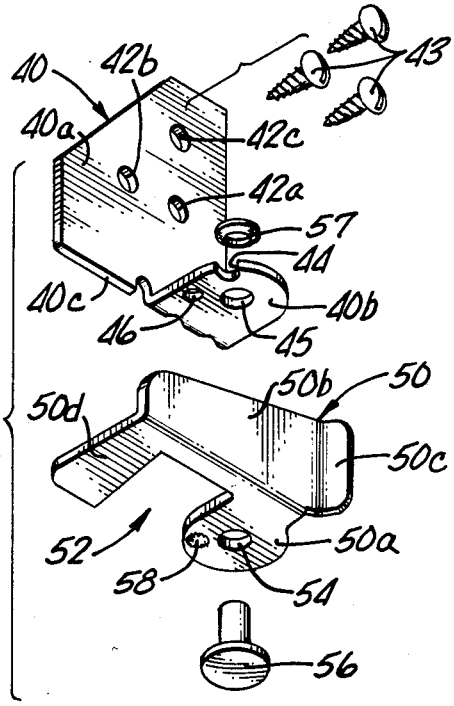
FIG. 2 is an exploded perspective view of the locking apparatus according to the invention.
Figure 3:
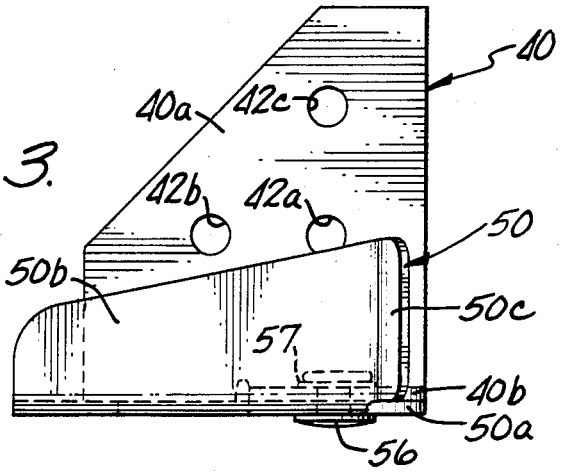
FIG. 3 is a plan view of the assembled locking apparatus of FIG. 2.

A latch arm member, generally designated 50, is formed from shaped sheet metal which is angularly bent to form first and second mutually perpendicular generally planar portions. The first planar portion **50*b* has, extending outwardly thereform, end portion 50*c* which forms a thumb or finger grip for pivoting of the latch arm member 50. The portion 50*b* forms a generally slightly tapered surface, tapering more narrowly away from end portion 50*c*. The second planar portion of latch arm member 50 has an arcuately configured portion 50*a* at the end thereof closest to end portion 50*c* and a spaced finger 50*d* formed at the opposite end, with the intervening space defining a latch recess 52. As can be seen in FIGS. 2 and 4, the inner edge of finger 50*d*, which, in part, defines the latch recess 52, diverges inwardly and downwardly, as viewed in FIG. 4**, the purpose of which will be hereafter described.

A pivot aperture 54 is formed in the side of arctuate portion **50*a* at the approximate center of the radius of the arctuate portion 50*a*. A suitable fastening member such as rivet 56 passes through the aperture 54 and through aperture 45 of plate member 40, with the opposite end thereof receiving a washer member 57, after which the end of rivet 56 is swaged to pivotally join members 40 and 50, with portion 40*b* of plate member 40 in relatively movable abutting relation with the radiused side of portion 50*a* of latch arm member 50. A protrusion 58 is formed in the surface of the radiused side of portion 50*a*, the protrusion 58 extending toward the adjacent surface of portion 40*b* of plate member 40. The protrusion 58 is displaced radially from the aperture 54, which defines the axis of pivoting, with the distance and angle of displacement being selected for coaction with both the depression 46 and recess 44 of plate member 40**.

By referring to FIGS. 2, 4 and 5, the purpose of these coacting protrusion and recess means will be described. In FIG. 4, the latch arm member is shown in solid lines designated 50, and in dotted lines designated 50′. A locking bar 20 is shown in dotted lines within the latch recess 52. In this position, which corresponds to the position shown in FIG. 1, the locking bar 20 is captively retained within the latch recess 52, with the depending end of finger **50*d* in proximate relation to the base portion 40a of the plate member 40. If an intruder were to attempt to open the door 12 from the outside, the bar 20 would move to the left, as viewed in FIG. 4, that is, toward the finger 50d. The bar 20 would then urge against the tapered edge of finger 50d, which acts to apply a downward force on the finger 50d. Thus the adjacent edge of finger 50d acts as a hook means to secure the bar 20** against forcible movement.

In the solid line position shown in FIG. 4, the protrusion 58 of the latch arm member 50 is coactingly detented within the depression 46 of the plate member 40. When the occupants desire to open the door 12, the latch arm member 50 is pivoted clockwise, as depicted in FIG. 4, by application of pressure to the thumb portion 50c, this clockwise pivoting continuing until the protrusion 58 coactingly detents within the arcuate recess 44 of plate member 40. In this position 50' of latch arm member 50, the member 50 is pivoted about sixty degrees, with the finger portion 50d elevated from the door 12 a distance sufficient to permit manipulation of the locking bars 20, 22 to an open position.

Additionally, it is to be emphasized that the latch arm member 50 in the dotted line position is sufficiently fixed to withstand pivoting while the vehicle is in motion, or when the vehicle is abruptly jarred. The frictional engagement occasioned by use of the arcuate recess 44 for maintaining the latch arm 50 in an open position assures that a much greater force is required to relatively pivot the parts, than the coaction of the protrusion 58 with the depression 46. In the closed position of the locking apparatus 10, a slight amount of movement is desirable to permit the camming action of the tapered edge of finger 50d when subjected to force.

FIGS. 6 and 7 demonstrate an alternate embodiment of the apparatus, the locking apparatus thereof being generally designated 60. The apparatus 60 includes a plate member 62 and a latch arm portion 64 suitably pivotally connected by rivet 66. The latch arm member 64 is virtually identical to latch arm member 50, however, the plate member 62 is configured somewhat differently than plate member 40. The plate member 62 includes a generally planar base potion 62a and a pivot portion 62b extending at right angles thereto. However, the pivot portion 62b is positioned intermediate the edges 62c and 62d of the base portion 62a. Viewing plate member 62 in end view, it is generally T-shaped, whereas plate member 40, when similarly viewed, is generally L-shaped. Furthermore the base portion 62a is more rectangular than base portion 40a, thus simplifying the stamping operation. The plate member 62 is provided with suitable apertures 67 for connection to a surface 70 of the vehicle or camper shell, as shown in FIG. 6.

In FIG. 6, the door 72 includes a door latch mechanism which is of the simplest variety, that is, the door handle shaft 75 is keyed to a short locking bar 77, which may be pivoted through an angle of about ninety degrees to the dotted line position 77', for locking and unlocking, respectively. In the locked position, as shown in solid lines, the locking bar 77 simply abuttingly overrides an adjacent surface 70, which is fixed relative to the vehicle, and which may be a portion of the camper shell, or may simply be the tail gate of the vehicle. The apparatus 60 is secured to the surface 70, such as by screws, in a position for receiving a part of the end of locking bar 77 within the opening 68 (FIG. 7) of latch arm 64 of apparatus 60.

The opening 68 is configured identically to the opening 52 of latch arm 50, and functions in the same way, that is, an attempt to rotate the locking bar 77 will result in a force being applied on the latch arm 64 in a direction toward the base portion 62a of the plate member 62. The position of the arcuate recess 69 on the pivot portion 62b and the coacting protrusion 71 on the latch arm member 64 have been slightly altered to facilitate manufacture, but still serve to keep the parts pivoted through an angle of about sixty degrees, with the frictional coaction maintaining the parts opened while traveling.

It is to be understood that either of the locking apparatus 10 or 60 may be used with any of the types of locking mechanisms currently utilized for pickup camper shells. Such locking apparatus, in accordance with the invention, may be readily mass-produced with suitable metal forming equipment, and provide an economical approach to assuring the safety of the occupants within the camper shell. While there have been shown and described preferred embodiment, it is to be understood that various other adaptations and modifications may be made within the spirit and scope of the invention.

I claim:

1. An inside door lock apparatus for a pickup truck camper shell having a pivotable door with a locking mechanism including at least one locking bar adjacent an interior surface of the door actuable by an external door handle, the locking bar being configured for engagement with a part of the shell or truck which is in fixed relation to the door, said at least one locking bar having one end thereof pivotably secured to an end of an actuating lever pivotable by said door handle and the other end thereof slidably restrained adjacent an edge of said door, said at least one locking bar being operable between first and second positions, said at least one locking bar, in said first positon having the other end thereof in engagement with a part of the shell or truck which is in fixed relation to the door with the longitudinal axis of said at least one locking bar lying along a line generally parallel to another edge of the door and, in said second position, having the one end displaced relative to the edge of the door and having the other end thereof out of engagement with a part of the shell or truck with the longitudinal axis of said at least one locking bar lying along a line at an angle to the edge of the door, said appartus comprising:

a plate member having means for securing the same to an interior surface adjacent said locking bar;

a latch arm member pivotally coupled to said plate member between a closed position and an open position, said latch arm member having a portion thereof configured for defining an opening positionable over said locking bar only with said at least one locking bar in said first position for captively retaining said locking bar from actuation with said latch arm member in the closed position and for enabling actuation of said locking bar with said latch arm member in the open position; and coacting means on said plate member and said latch arm member for frictionally retaining said latch arm member in an open position whereby to prevent inadvertent closing of said latch arm member with the vehicle in motion.

2. The apparatus according to claim 1 wherein said plate member is metallic and includes a generally planar base portion with apertures therethrough for receiving fasteners for securing the same to an interior surface.

3. The apparatus according to claim 2 wherein said plate member includes an integrally formed pivot portion extending generally perpendicular to the plane of said base portion.

4. The apparatus according to claim 3 wherein said latch arm member is formed of bent metal and said portion defining an opening is a generally planar portion having a surface configured for pivotable attachment to said pivot portion.

5. The apparatus according to claim 4 wherein said coacting means includes dimple means and recess means formed on abutting surfaces on said pivot portion and a surface of said latch arm member adjacent the pivot coupling point thereof.

6. The apparatus according to claim 3 wherein said pivot portion is adjacent an edge of said base portion.

7. The apparatus according to claim 3 wherein said pivot portion is intermediate opposite edges of said base portion.

8. An inside door lock apparatus for a pickup truck camper shell having a door hinged about a first edge with a locking mechanism including at least one locking bar adjacent the interior surface of the door actuable by an external door handle, the locking bar being configured for engagement with a part of the shell or truck which is in fixed relation to the door, said at least one locking bar having one end thereof pivotably secured to an end of an actuating lever pivotable by said door handle and the other end thereof slidably restrained adjacent an edge of said door opposite said first edge, said at least one locking bar being operable between first and second positions, said at least one locking bar, in said first position having the other end thereof in engagement with the part of the shell or truck which is in fixed relation to the door, with the longitudinal axis of said at least one locking bar lying along a line generally parallel to said door edge opposite said first edge and, in said second position, said at least one locking bar having the one end displaced relative to said door edge opposite said first edge and having the other end thereof out of engagement with the part of the shell or truck, with the longitudinal axis of said at least one locking bar lying along a line at an angle to the edge of the door, said apparatus comprising:

a plate member having a base portion for securing the same to an interior surface adjacent said locking bar, and a generally perpendicular pivot portion;

a latch arm member formed from sheet metal and having first and second generally mutually perpendicular portions, said first portion having an end thereof pivotally coupled to said pivot portion for pivoting between a closed position and an open position, said second portion having a finger spaced from the pivot end configured for defining an opening positionable over said locking bar only with said at least one locking bar in said first position for captively retaining said locking bar from actuation with said latch arm member in the closed position and for enabling actuation of said locking bar with said latch arm member in the open position; and coacting means on said plate member and said latch arm member for frictionally retaining said latch arm member in an open position whereby to prevent inadvertent closing of said latch arm member with the vehicle in motion.

9. The apparatus according to claim 8 wherein said finger has a tapered edge adjacent said opening, the taper being in a direction to urge said latch arm member toward said base portion with said latch arm member in the closed position and force exerted on said locking bar.

10. The apparatus according to claim 9 wherein said coacting means includes dimple means and recess means formed on abutting surfaces of said pivot portion and the adjacent surface of said first portion of said latch arm member.

11. The apparatus according to claim 10 wherein said pivot portion is adjacent an edge of said base portion.

12. The apparatus according to claim 10 wherein said pivot portion is intermediate opposite edges of said base portion.

13. A door lock apparatus for a pickup truck camper shell having a door hinged along a first edge thereof, said apparatus comprising:

a locking mechanism secured to said door and including an external door handle adjacent a second door edge opposite said first edge, and an internal actuating lever pivotable in response to pivoting of said door handle;

at least one locking bar adjacent an interior surface of the door having one end thereof pivotably secured to an end of said actuating lever and the other end thereof slidably restrained adjacent said second door edge, said at least one locking bar being operable between first and second positions, said at least one locking bar, in said first position having other end thereof in engagement with a part of the shell or truck which is in fixed relation to the door with the longitudinal axis of said at least one locking bar lying along a line generally parallel to said second door edge, and, in said second position, having the one end displaced relative to the edge of the door and having the other end thereof out of engagement with a part of the shell or truck with the longitudinal axis of said at least one locking bar lying along a line at an angle to said second door edge;

a plate member having a base portion for securing the same to an interior surface adjacent said locking bar, and a generally perpendicular pivot portion;

a latch arm member formed from sheet metal and having first and second generally mutually perpendicular portions, said one portion having an end thereof pivotally coupled to said pivot portion for pivoting between a closed position and an open position, said one portion having a finger spaced from the pivot end configured for defining an opening positionable over said locking bar only with said at least one locking bar in said first position for captively retaining said locking bar from actuation with said latch arm member in the closed postion and for enabling actuation of said locking bar with said latch arm member in the open position; and coacting means on said plate member and said latch arm member for frictionally retaining said latch arm member in an open position whereby to prevent inadvertent closing of said latch arm member with the vehicle in motion.

14. The apparatus according to claim 13 wherein said finger has a tapered edge adjacent said opening, the taper being in a direction to urge said latch arm member toward said base portion with said latch arm member in the closed position and force exerted on said locking bar.

15. The apparatus according to claim 13 wherein said coacting means includes dimple means and recess means formed on abutting surfaces of said pivot portion and a surface adjacent the pivot point thereof.

16. The apparatus according to claim 13 wherein said plate member includes an integrally formed pivot portion extending generally perpendicular to the plane of said base portion.

17. The apparatus according to claim 16 wherein said latch arm member is formed of bent metal and said portion defining an opening is a generally planar portion having a surface configured for pivotable attachment to said pivot portion.

18. The apparatus according to claim 17 wherein said coacting means includes dimple means and recess means formed on abutting surfaces of said pivot portion and a surface adjacent the pivot point thereof.

* * * * *